US005907921A

United States Patent [19]

Rose et al.

[11] Patent Number: 5,907,921

[45] Date of Patent: Jun. 1, 1999

[54] BALLISTIC OPTIMIZING SYSTEM FOR RIFLES

[75] Inventors: Clyde E Rose, South Weber, Utah; Edward P Schmitter, Blythewood, S.C.

[73] Assignee: FN Manufacturing Inc, Columbia, S.C.

[21] Appl. No.: 08/918,850

[22] Filed: Aug. 26, 1997

[51] Int. Cl.[6] ..... F41C 27/00

[52] U.S. Cl. ..... 42/97; 42/76.01

[58] Field of Search ..... 42/97, 76.01

[56] References Cited

U.S. PATENT DOCUMENTS

| | | | |
|---|---|---|---|
| Re. 35,381 | 11/1996 | Rose . | |
| 2,240,681 | 5/1941 | Swartz | 42/1 |
| 4,726,280 | 2/1988 | Frye | 89/16 |
| 5,279,200 | 1/1994 | Rose . | |
| 5,509,345 | 4/1996 | Cyktich | 89/14.05 |
| 5,698,810 | 12/1997 | Rose | 89/14.3 |

*Primary Examiner*—Charles T. Jordan
*Assistant Examiner*—Meena Chelliah
*Attorney, Agent, or Firm*—Michael A Mann; Nexsen Pruet Jacobs & Pollard LLP

[57] ABSTRACT

A ballistic optimizing system for use on a rifle comprises an axially movable weight threadedly secured to the end of a rifle barrel such that movement of the weight can be used to change vibrational characteristics of the rifle when it is fired. By damping vibrations of the barrel at the muzzle, a bullet can exit the barrel at the point of minimal vertical deflection so that accuracy is improved. To secure the weight element into a desired position, a tooth on a spring carried on the weight is received into one of a plurality of axial grooves equally spaced around the circumference of the rifle barrel. Additionally, a compression spring in an annular space between the barrel and the weight applies greater frictional engagement between the threads of the weight and the threads of the barrel so that alignment of the weight with respect to the barrel is improved. Finally, a nylon insert can be placed in longitudinal grooves cut across the threads of the barrel to remove substantially all traces of play between the weight and the barrel.

19 Claims, 2 Drawing Sheets

BALLISTIC OPTIMIZING SYSTEM FOR RIFLES

BACKGROUND OF INVENTION

This invention relates to rifles and particularly to systems for increasing the accuracy of rifles. More particularly, it is directed to systems including weight devices affixed to the muzzle end of rifle barrels to dampen vibration resulting from the firing of bullets through such barrels.

BACKGROUND OF INVENTION

There has long been a desire among marksmen for firearms to be as accurate and consistent as possible during firing. This desire is particularly characteristic of marksmen who engage in rifle target shooting competitions and military sniper operations. Consequently, considerable effort has been made to eliminate or at least minimize those factors that adversely affect accurate shooting. It is well recognized that barrel vibration which inevitably occurs upon firing of the weapon adversely affects accurate rifle marksmanship. Attempts to eliminate such barrel vibration have involved the use of various types and kinds of bedding materials as shock absorbers and dampeners between the barrel and the action assemblies and stocks of a rifle. The kinds and positions of mounting screws associated with the components of a rifle have been the subject of design scrutiny. Different stock and barrel configurations have been tried. Nevertheless, inconsistent paths of trajectory of ballistic slugs discharged from their muzzles remain inherently characteristic of rifles.

It has been recognized that, in some cases, it is possible to "match" a particular rifle with a particular cartridge to minimize barrel vibration, thereby increasing accuracy. To "match" a cartridge with a particular rifle, it may be necessary to vary bullet weight or type, the type or amount of powder used, or other factors. The best match of ammunition will result in the exiting of a bullet from the barrel muzzle at or as near as possible to an anti-node (i.e., peaks and valleys that correspond to minimum barrel velocity) of the vibration curve representative of transverse barrel vibrations induced by the firing of the rifle. When the exit of the bullet is at a node of the vibration curve as plotted against time, minimal bullet path deflection occurs (see FIG. 5). According to FIG. 5, which shows the vertical oscillation of the barrel of a rifle upon firing versus time, during t1 at one of the nodes (or anti-n) the vertical oscillation is d1, and during t2 it is d2.

Weights have been heretofore attached to the muzzle ends of rifle barrels as a means of dampening barrel vibrations set in motion by discharge of the firearm. U.S. Pat. No. 4,726,280, for example, discloses mounting a muzzle member on the muzzle end of a gun barrel. Although not stated in U.S. Pat. No. 4,726,280, it is generally understood that such a muzzle member may serve as a counterweight. The muzzle member is threaded onto the barrel and is locked in place. Anschutz and Co. G.M.B., through the 1989 catalog of its distributor, Precision Sales International, Inc. of Westfield, Mass., discloses at pages 11 and 16 barrel extensions for rifles that include removable weights. Although not stated in the 1989 catalog of Anschutz and Co. G.M.B., it is understood that interchanging such weights may enable a marksman to selectively vary the amount of weight used for dampening purposes. In addition, U.S. Pat. No. 5,279,200 (Reissue No. 35,381) discloses a ballistic optimizing system comprising a movable weight element secured to the end of a rifle barrel; however, the device disclosed in U.S. Pat. No. 5,279,200 and its reissue lacks adequate means for securing the weight member at a desired position. As a result, the forces exerted during repeated use can cause the weight member to shift from the desired setting and thus, either adversely affect the shooting accuracy on subsequent uses or require the user to repeatedly reset the device.

SUMMARY OF THE INVENTION

The present invention is an improvement in the ballistic optimizing system (BOS) of U.S. Pat. No. 5,279,200 that provides a more accurate and reliable means for securing a weighted element in a desired position on the barrel of a rifle, thereby further increasing the shooting accuracy otherwise achievable. The invention includes a weight element added to the muzzle end of a rifle barrel. The vibrational characteristics of the barrel can be changed by adjusting the axial position of the weight element with respect to the barrel, either toward or away from its muzzle end. The weight element is locked into a desired axial position when a tooth member carried by the weight is received in one of a plurality of depressions or axial grooves equally spaced around the circumference of the rifle barrel. When the BOS is properly positioned and secured, the rifle will "match" a particular ammunition; that is, the bullet for which the weight element is properly positioned will exit the muzzle at an optimum time to experience minimum barrel travel deflection (see FIG. 5). Thus, it is unnecessary to select ammunition based upon the inherent responses of a particular rifle. Furthermore, factory-loaded ammunition can be repeatedly fired with accuracies heretofore unobtainable. Moreover, different factory-loaded cartridges can be fired accurately from the same rifle merely by making appropriate adjustments to the BOS.

According to the present invention, the weight element is selectively repositioned forwardly toward or rearwardly away from the muzzle end of a rifle barrel. The mass of the weight element thus becomes a controlling mass. The rifle is matched to a particular ammunition by positioning of the weight element to an empirically determined location, referred to as the "sweet spot." The "sweet spot" is that location of the weight element along the axis of a rifle barrel at which the trajectories of a series of substantially similar bullets discharged from the muzzle of the rifle held in a stationary position exhibit a minimum deviation (see FIG. 5). The weight is locked into this "sweet spot" setting by a tooth member carried by the weight element when it engages one of a plurality of axial grooves cut into the barrel. The weight element may need to be repositioned to find the "sweet spot" of the rifle for a different cartridge. It has been found that in some instances even very small movements of the controlling adjustable mass will improve the accuracy of a rifle.

In a preferred embodiment of the invention, a compression spring surrounds the distal end of a rifle, positioned between the stepped down, flanged surface of the threads on the muzzle end of a rifle barrel and the stepped down, flanged surface within the bore of the weight in order to urge the rifle barrel and the weight element apart. This spring force secures the position of the rifle barrel and the weight with respect to each other and centers the weight in relation to the barrel centerline. Additionally, a nylon insert can be placed in longitudinal grooves cut across the threads to remove substantially all traces of play between the weight and the barrel.

Other features and their advantages will be apparent to those skilled in the art from a careful reading of the Detailed Description of Illustrated Embodiments accompanied by the following drawings.

DESCRIPTION OF THE ILLUSTRATED EMBODIMENTS

Figure 1:
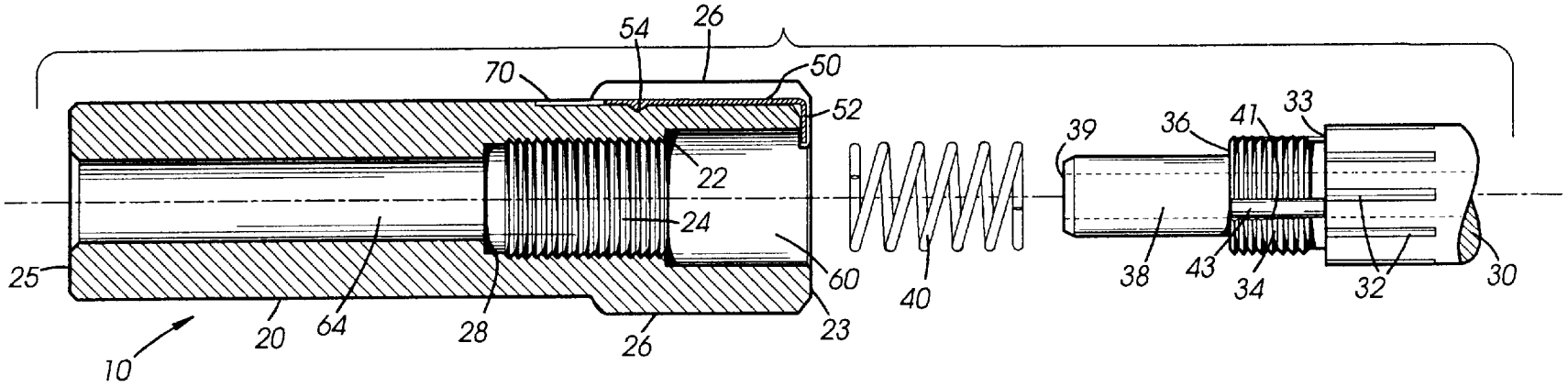
FIG. 1 is an exploded side cross-sectional view of a ballistic optimizing device according to a preferred embodiment of the present invention.
Figure 2B:
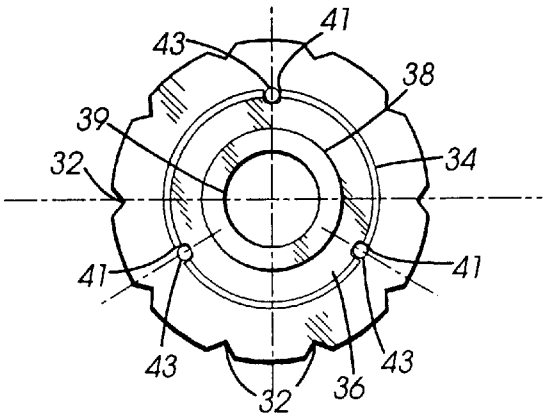
FIG. 2B is an end view of the barrel of FIG. 1 showing the axial grooves in the threads and the nylon strings in the grooves.
Figure 2A:
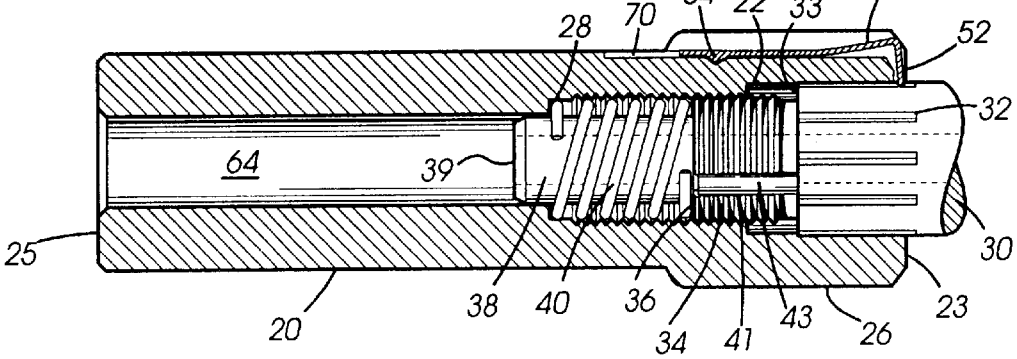
FIG. 2A is a side cross-sectional view of an assembled ballistic optimizing device according to a preferred embodiment of the present invention.

In the illustrated preferred embodiments of FIGS. 1, 2A and 2B, the system of the invention includes a rifle barrel vibration dampener, shown generally at 10, threaded onto a rifle barrel 30. The barrel 30 is stepped down at a shoulder 33 to a section 34 having exterior threads, which is further stepped down at a shoulder 36 to a muzzle 38 having a distal end 39. Into the threads of section 34, several, preferably three, equally-spaced, longitudinal grooves 41 can be cut. A nylon string 43 can be inserted into grooves 41. For example, if three grooves are cut, each is 120° apart and may be 0.062 inches wide, 0.060 inches deep.

A hollow cylindrical weight 20 has first opening 60 at end 23 dimensioned for receiving rifle barrel 30. First opening 60 is stepped down at a shoulder 22 to a section 24 having interior threads. Threaded section 24 is further stepped down at shoulder 28 to passage 64. Passage 64 is dimensioned for receiving distal end 39 of muzzle 38. Surrounding muzzle 38 and resting against shoulders 28 and 36 is a spring 40 in the annular recess formed by the combination of the stepped down portions of barrel 30 and weight 20. When spring 40 is placed onto this annular recess and barrel 30 inserted into and threadably secured to cylindrical weight 20, spring 40 is compressed, thereby urging the exterior threads of rifle barrel 30 into frictional engagement with the interior threads of cylindrical weight 20. Spring 40 helps to center weight 20 with respect to the centerline of barrel 30 because it applies an axial force evenly around the circumference of both barrel 30 and weight 20. Grooves 41 with nylon strings 43, best seen in FIG. 2B, help to remove any remaining traces of play or "wobble" between weight 20 and barrel 30. Nylon string 43 interferes with the threading and therefore substantially eliminates all play.

Figure 3:
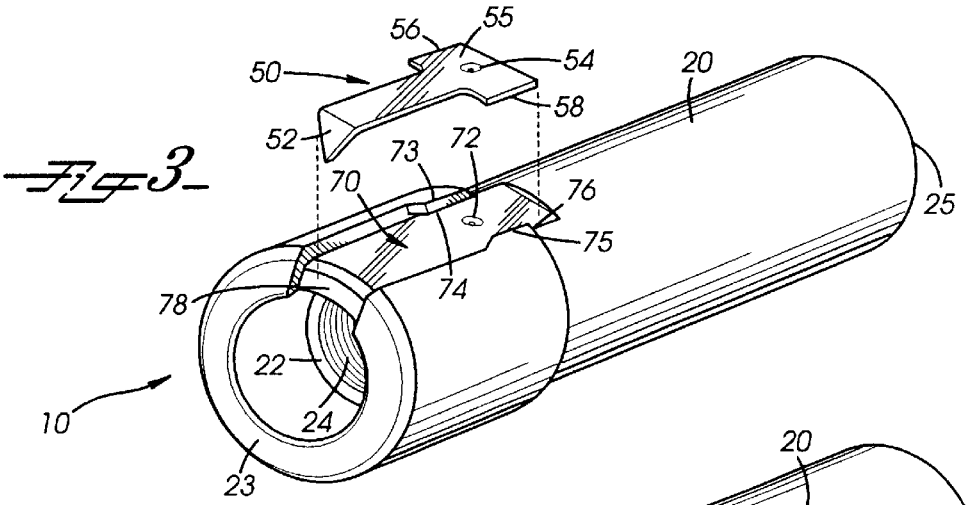
FIG. 3 is an exploded perspective view of a weight element of a ballistic optimizing device according to a preferred embodiment of the present invention.
Figure 4:
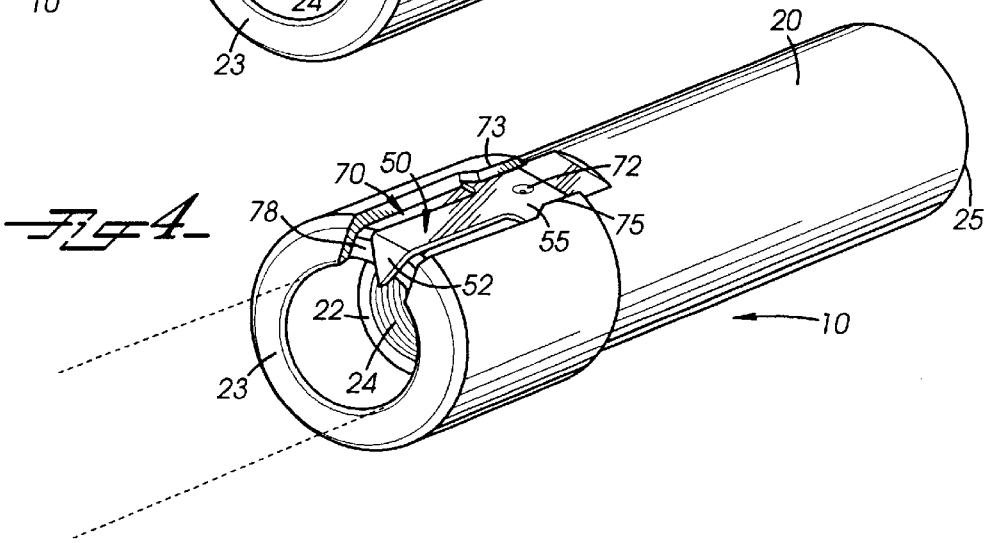
FIG. 4 is a perspective view of a weight element of a ballistic optimizing device according to a preferred embodiment of the present invention.
Figure 5:
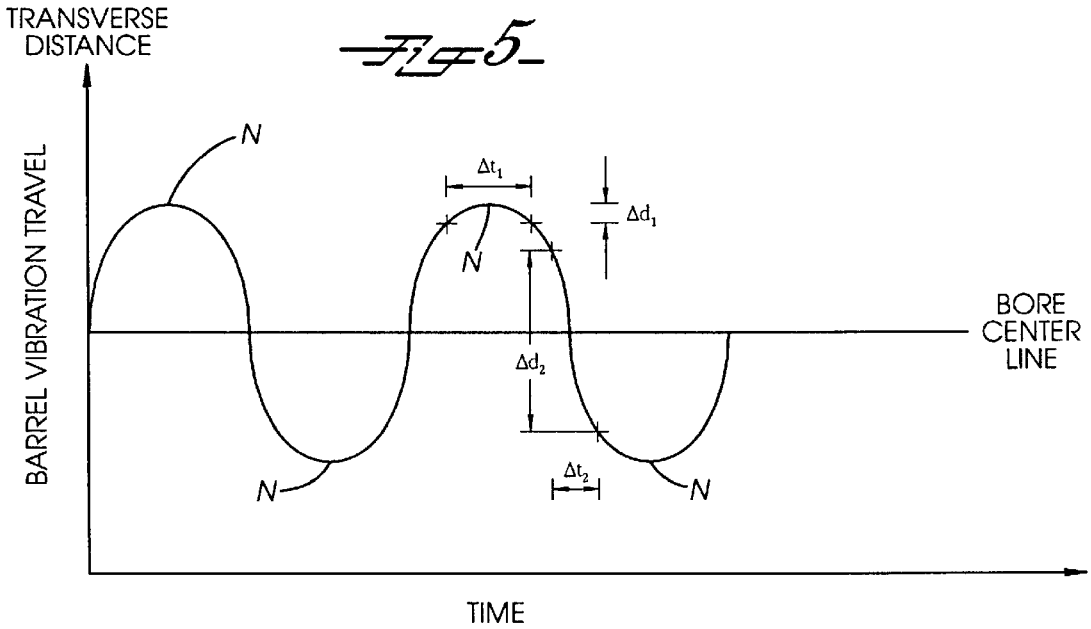
FIG. 5 is an exemplary curve representative of transverse rifle barrel vibrations after firing of a bullet, plotted against time.

To prevent rotation of cylindrical weight 20 with respect to rifle barrel 30, as seen in FIGS. 3 and 4, a spring member 50 having a tooth 52 on cylindrical weight 20 engages one of a plurality of depressions or grooves 32 formed therein, preferably evenly spaced, about the circumference of rifle barrel 30. Cylindrical weight 20 has a recessed area 70 for receiving spring member 50. Spring member 50 has a shoulder 55 having a first end 56 and a second end 58. First end 56 and second end 58 of shoulder 55 are dimensioned to slip under lip 73 and lip 75, respectively, and into recessed area 70 of tubular weight 20. Additionally, shoulder 55 of spring member 50 has dimple 54 that aligns with corresponding dimple 72 in recessed area 70, where it is staked in place to further secure and align spring member 50 in recessed area 70. The staking of dimple 54 into dimple 72 and the slip fit of first end 56 and second end 58 of shoulder 55 assure that spring member 50 is secured to cylindrical weight 20 and will not slip, rotate, or shift.

Tooth 52 of spring member 50 is perpendicular to the plane of recessed area 70 and extends just past end lip 78, short of end 23 and slightly into first opening 60, so tooth 52 is less likely to catch onto other objects. When installing rifle barrel 30 into cylindrical weight 20, a force is applied by the user to slightly lift spring member 50 until rifle barrel 30 clears tooth 52. Then cylindrical weight 20 can be rotated with respect to barrel 30 to change the vibrational characteristics of the rifle.

In use, as cylindrical weight 20 is rotated with respect to barrel 30, tooth 52 slides over the circumference of barrel 30 until tooth 52 engages a groove 32, at which point it is urged into groove 32 by the spring force of spring member 50. An upward force is exerted on tooth 52 by groove 32 when the user rotates weight 20, thus disengaging it from groove 32. This feature ensures that tooth 52 does not work itself out of groove 32 and that tubular weight 20 does not unintentionally rotate during firing of the rifle. Based on the number of grooves 32 and the number of threads per inch on threaded sections 24 and 34, each rotation of cylindrical weight 20, causing tooth 52 to advance to an adjacent groove 32, corresponds to a predeterminable axial advancement along the rifle barrel 30, either toward or away from distal end 39.

Axial grooves 41 formed in barrel 30 permit receipt of nylon strings 43. The threads of threaded section 24 can rotate easily over strings 43, but strings 43 will help limit axial movement or "wobble." Although close tolerances and careful manufacturing and the use of spring 40 help threaded sections 24 and 34 hold weight 20 in a fixed axial relation with respect to barrel 30, nylon strings 43 also help to hold them in fixed axial relationship so that axial wobble is all but eliminated. In rifles subject to firing larger number of rounds at one time, the barrel may heat beyond a temperature range suitable for the stability of nylon. In such a case other materials, such as high temperature synthetics or metals softer than barrel material, may be substituted, or strings 43 may be eliminated.

It will be apparent to those skilled in the art that many changes and substitutions can be made to the preferred embodiment herein described without departing from the spirit and scope of the present invention as defined by the following claims.

What is claimed is:

1. A ballistic optimizing system comprising:

a rifle having a barrel, said barrel having exterior threads;

a hollow cylindrical weight having interior threads, said weight element threadably carried by said barrel so that said weight can rotate with respect to said barrel; and a tooth carried by said weight, said barrel having means formed therein for receiving said tooth, said tooth preventing rotation of said weight with respect to said barrel when said tooth is received in said receiving means.

2. The ballistic optimizing system of claim 1, wherein said securing means is a spring carried by said weight and having a tooth, and said barrel has means formed therein for receiving said tooth, said tooth preventing rotation of said weight with respect to said barrel when said tooth is received in said receiving means, said spring urging said tooth into said receiving means.

3. The ballistic optimizing system of claim 1, wherein said receiving means is a plurality of grooves formed in said barrel.

4. The ballistic optimizing system of claim 1, further comprising means for holding said weight in fixed axial relation to said barrel.

5. The ballistic optimizing system of claim 1, further comprising a compression spring positioned between said barrel and said hollow cylindrical weight so that said weight is urged axially with respect to said barrel and said interior and exterior threads into frictional engagement and axial alignment.

6. The ballistic optimizing system of claim 1, wherein said exterior threads of said barrel have axial grooves formed therein, and said ballistic optimizing system further comprises nylon strings in said axial grooves.

7. The ballistic optimizing system of claim 1, further comprising a spring surrounding said distal end of said barrel and which is carried by said barrel for urging said weight element and said barrel in opposite axial direction when said barrel is engaged with said weight element, and wherein said weight element is tubular.

8. A ballistic optimizing system comprising:

a rifle having a barrel, said barrel having exterior threads;

a hollow cylindrical weight having interior threads, said weight threadably carried by said barrel so that said weight can rotate with respect to said barrel to move said weight axially with respect to said barrel;

means carried by said weight for securing said weight to said barrel so that said weight does not rotate with respect to said barrel; and means for urging said exterior threads of said barrel in engagement with said interior threads of said weight.

9. The ballistic optimizing system as recited in claim 8, wherein said urging means is a spring in engagement with said barrel and said weight.

10. The ballistic optimizing system as recited in claim 8, wherein said weight is formed to have a stepped down portion and said barrel is formed to have a stepped down portion, said stepped down portions of said barrel and said weight forming an annular space, said urging means further comprising a compression spring positioned within said annular space.

11. The ballistic optimizing, system as recited in claim 8, wherein said securing means further comprises a spring, carried by said weight, said spring having a tooth, and said barrel having means formed therein for receiving said tooth, said spring urging said tooth into said receiving means, said tooth preventing rotation of said barrel with respect to said weight when said tooth is received by said receiving means.

12. The ballistic optimizing system as recited in claim 8, wherein said securing means further comprises a spring carried by said weight, said spring having a tooth, and said barrel having a plurality of grooves formed therein dimensioned to receive said tooth, said tooth preventing rotation of said barrel with respect to said weight when said tooth is in one groove of said plurality of grooves.

13. The ballistic optimizing system as recited in claim 12, wherein said grooves are equally spaced about the circumference of said barrel.

14. The ballistic optimizing system as recited in claim 11, wherein said spring has a shoulder having a first end and a second end, and said weight has a first lip and a second lip, and wherein said spring is fitted to said weight by inserting said first end under said first lip and said second end under said second lip to hold said spring in position on said weight.

15. The ballistic optimizing system as recited in claim 14, wherein said shoulder has a dimple and said weight has a dimple, and said dimple of said shoulder is staked to said dimple of said weight to hold said spring in position on said weight.

16. A ballistic optimizing system comprising:

a rifle having a barrel, said barrel having exterior threads, a stepped down portion, and depressions formed therein;

a hollow cylindrical weight having interior threads and a stepped down portion, said weight element threadably carried by said barrel so that said weight can rotate with respect to said barrel to move said weight axially with respect to said barrel, said stepped down portions of said barrel and said weight forming an annular space therebetween;

a spring carried by said weight and having a tooth, said tooth preventing axial rotation of said barrel with respect to said weight when said tooth is received in said depressions; and a compression spring positioned within said annular space for urging said threads of said barrel into greater frictional engagement with said threads of said weight and for centering said barrel with respect to said weight.

17. The ballistic optimizing system as recited in claim 16, wherein said depressions are equally spaced about the circumference of said barrel.

18. The ballistic optimizing system as recited in claim 16, wherein said spring has a shoulder having a first end and a second end, and said weight has a first lip and a second lip, and wherein said spring is fitted to said weight by inserting said first end under said first lip and said second end under said second lip to hold said spring in position on said weight.

19. The ballistic optimizing system as recited in claim 16, wherein said exterior threads of said barrel have axial grooves formed therein, and said ballistic optimizing system further comprises nylon strings in said axial grooves.

* * * * *

UNITED STATES PATENT AND TRADEMARK OFFICE
Certificate

Patent No. 5,907,921 Patented: June 1, 1999

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: James R.G. Brunette, Columbia, SC; Edward P. Schmitter, Blythewood, SC; and Clyde E. Rose, South Weber, Utah Signed and Sealed this Seventh Day of May 2002.

CHARLES T. JORDAN
*Supervisory Patent Examiner*
*Art Unit 2200*